US005988020A

United States Patent [19]

Johnson

[11] Patent Number: 5,988,020

[45] Date of Patent: Nov. 23, 1999

[54] HAMMERHEAD

[76] Inventor: Ray W. Johnson, 151 N. Gow, Wichita, Kans. 67203

[21] Appl. No.: 09/002,609

[22] Filed: Jan. 5, 1998

[51] Int. Cl.[6] ..... B25D 1/00

[52] U.S. Cl. ..... 81/23; 81/24

[58] Field of Search ..... 81/20, 23, 24

[56] References Cited

U.S. PATENT DOCUMENTS

| | | | |
|---|---|---|---|
| 299,717 | 6/1884 | Barber | 81/23 |
| 450,011 | 4/1891 | Hackett | 81/23 |
| 2,597,876 | 5/1952 | Kurkjian | 81/23 |
| 3,987,828 | 10/1976 | Matheis | 81/24 |
| 4,273,172 | 6/1981 | Hoosier | 81/23 |
| 4,465,115 | 8/1984 | Palomera | 81/24 |

FOREIGN PATENT DOCUMENTS

| | | | |
|---|---|---|---|
| 141678 | 10/1949 | Australia | 81/24 |

*Primary Examiner*—Eileen P. Morgan
*Assistant Examiner*—Joni B. Danganan
*Attorney, Agent, or Firm*—Edwin H. Crabtree; Ramon L. Pizarro; Donald W. Margolis

[57] ABSTRACT

A hammerhead used for magnetically holding different sizes and lengths of nails. Also, the hammerhead can be used for holding tacks, brads and other types of fasteners. The hammerhead is used to start the initial driving of a nail into a nail receiving surface and avoids the holding of the nail with one hand and possibly hitting the hand with the hammerhead. The hammerhead is characterized by having a head member with an outwardly extending annular shaped nose. The nose includes a rear portion integral to and extending outwardly from the head member, a front portion with a nail striking face, a top portion and a bottom portion. The length of the top portion of the nose includes a "V" shaped groove for receiving a portion of the nail therein. A magnet hole, in the top portion of the nose, is disposed next to the nail striking face. The magnet hole is used for receiving a magnet with a non-magnetic sleeve therearound. Extending downwardly from the magnet hole is a knock-out hole which is used for removing the magnet when the magnet is damaged or it loses it's magnetic flux. The top of the magnet is disposed along the length of the "V" shaped groove for holding the nail received in the groove. The top portion also includes a nail head slot at one end of the "V" shaped groove for receiving different size nail heads.

13 Claims, 1 Drawing Sheet

HAMMERHEAD

BACKGROUND OF THE INVENTION (a) Field of the Invention

This invention relates to hand held hammers and more particularly, but not by way of limitation, to an improved hammerhead for holding various types of nails and fasteners thereon.

(b) Discussion of Prior Art

Heretofore there have been a variety of different types of hammers using magnets and nail retaining clips for holding a nail when starting the nail into a nail receiving surface.

In U.S. Pat. No. 2,597,876 to Kurkjian and U.S. Pat. No. 4,465,115 to Palomera, hammers are shown with a magnet mounted in the hammerhead for holding a nail in place during the initial driving of the nail into a nail receiving surface. In the Palomera patent, the hammerhead is shown with a magnet held therein using a threaded screw. A longitudinal recess is formed in the top of the hammerhead for receiving a nail with the magnet holding the nail in the recess. The hammerhead described in the Palomera patent does not provide for handling nails of different sizes and lengths. Also, the Palomera patent does describe means for increasing the life of a magnet when mounted on the hammerhead and for providing increased holding power when the nail is engaged by the magnet on top of the hammerhead.

In U.S. Pat. No. 115,008 to Young, U.S. Pat. No. 759,556 to Scholtes, U.S. Pat. No. 1,258,058 to Starrett, U.S. Pat. No. 1,443,864 to Blustein et al., U.S. Pat. No. 1,922,890 to Gevert and U.S. Pat. No. 745,973 to Starrett various types of nail retaining clips are disclosed and mounted on various locations on the hammerhead for starting a nail.

None of the above mentioned patents provide for a magnet next to a nail striking face of a hammerhead for holding different size nails and fasteners for driving the nail or fastener initially into a surface. Also, none of the above mentioned patents and prior art hammers incorporate the unique combination of structure and function of the subject improved hammerhead with magnet nail holder as described herein.

SUMMARY OF THE INVENTION

In view of the foregoing, it is a primary object of the present invention to provide an improved hammerhead which is used for magnetically holding different types, sizes and lengths of nails. The hammerhead is used to start the initial driving of a nail into a nail receiving surface and avoids the holding of the nail with one hand and possibly hitting the hand with the hammerhead. Another object of the invention is the hammerhead can be used for holding tacks, brads and other types of fasteners.

Still another object of the improved hammerhead is the use of a magnet with an insulated non-magnetic sleeve for extending the life of the magnet when mounted in the top of a steel hammerhead. Also the hammerhead includes a knock-out hole which is used for removing the magnet when the magnet is damaged or the magnet no longer has any magnetic flux for holding nails on the hammerhead.

Yet another feature of the hammerhead is a nail head slot which is used for receiving different size nail heads therein and double headed scaffold nails. The nail head slot includes a upright striking surface for engaging the nail head when it is initially driven into a nail receiving surface.

A further feature of the hammerhead is a "V" shaped groove along the length of the nose of the hammerhead for holding a portion of the length of the nail and a portion of the top of the magnet. The top of the magnet also has a groove therein for providing greater magnetic holding power of the nail.

The improved hammerhead includes a head member with an outwardly extending annular shaped nose. The nose includes a rear portion integral to and extending outwardly from the head member, a front portion with a nail striking face, a top portion and a bottom portion. The length of the top portion of the nose includes a "V" shaped groove for receiving a portion of the nail therein. A magnet hole, in the top portion of the nose, is disposed next to the nail striking face. The magnet hole is used for receiving a magnet with an insulated non-magnetic sleeve therearound. Extending downwardly from the magnet hole is a knock-out hole which is used for removing the magnet when the magnet is damaged or it loses it's magnetic flux. The top of the magnet is disposed along the length of the "V" shaped groove for holding the nail received in the groove. The top portion also includes a nail head slot at one end of the "V" shaped groove for receiving different size nail heads. The slot includes an upright striking surface for engaging one end of a nail head when the nail is received in the groove in the top portion of the nose. The upright striking surface is used for driving the nail initially into the nail receiving surface.

These and other objects of the present invention will become apparent to those familiar with hammers and hammerheads from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
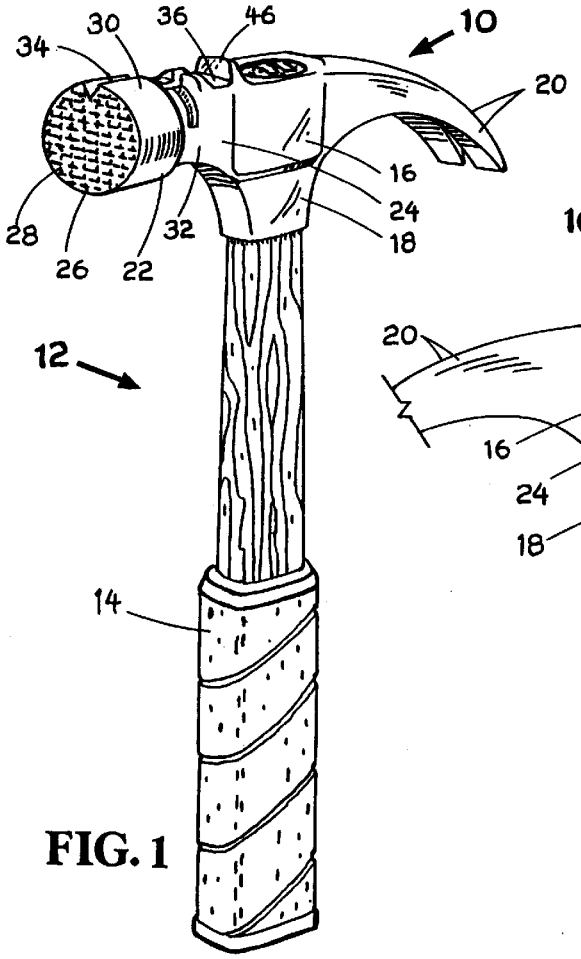
FIG. 1 is a perspective view of the improved hammerhead which has been incorporated into a claw hammer with handle.

In FIG. 1, a perspective view of the subject improved hammerhead is shown having general reference numeral 10.

The new hammerhead has been incorporated into a claw hammer having general reference numeral 12. The claw hammer 12 includes a handle 14. While the claw hammer 12 is shown in this drawing, it should be kept in mind that various types and sizes of hammers can be used with the subject improved hammerhead 10 without departing from the spirit and scope of the invention.

The hammerhead 10 is characterized by having a head member 16 with a downwardly extending neck member 18 used for mounting on top of the handle 14. While the handle 14 is shown attached to the neck member 18, it can be appreciated that a one piece claw hammer 12 could be made with the handle 14 incorporated into and integral to the head member 16. The hammerhead 10 also includes a pair of claws 20 for pulling nails and the like. The claws 20 extend rearwardly from and are integral to the head member 16.

An annular shaped nose 22 extends outwardly from the head member 16. The nose 22 of the unique hammerhead 10 includes a rear portion 24 integral to and extending outwardly from the head member 16, a front portion 26 with a nail striking face 28, a top portion 30 and a bottom portion 32. A length of the top portion 30 of the nose 22 includes a "V" shaped groove 34 for receiving a portion of the nail therein and a slot 36. The slot 36 is used for receiving a nail head therein as shown in FIG. 2.

Figure 2:
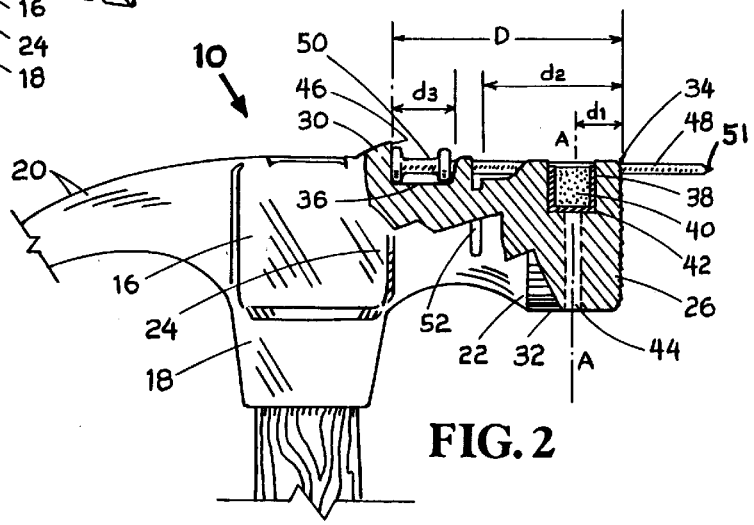
FIG. 2 is a side view of the hammerhead with a portion of the nose of the hammerhead cut away. This figure illustrates a magnet with knock-out hole disposed next to a nail striking face of the nose.

In FIG. 2, a side view of the hammerhead 10 is illustrated with a large portion of the nose 22 of the hammerhead 10 cut away. This drawing illustrates a magnet hole 38 extending downwardly from the "V" shaped groove 34 in the top portion 30 of the nose 22. The magnet hole 38 is used for receiving a magnet 40 with the sides and bottom of the magnet 40 surrounded by a non-magnetic sleeve 42. The top of the magnet 40 is exposed to the "V" shaped groove 34 for engaging a portion of a nail received therein. Extending downwardly from the magnet hole 38 is a small knock-out hole 44. The knock-out hole 44 opens at the bottom of the bottom portion 32 of the nose 22. The knock-out hole 44 is used for removing the magnet 40 when it is damaged or it loses it's magnetic flux in holding nails in the "V" shaped groove 34. The sleeve 42 may be made of brass, aluminum or any other non-ferrous metal or alloy. The sleeve 42 is used for extending the life of the magnet 40 and to prevent the magnet 40 from losing it's magnetic flux prematurely when exposed next to a steel metal alloy used in the construction of the hammerhead 10. The magnet 40 and sleeve 42 are shown in cross section in this drawing.

An important feature of the hammerhead 10 is a length "D" which extends from the striking face 28 along the length of the "V" shaped groove 34 and the length of the slot 36 to an upright striking surface 46. The striking surface 46 is used for engaging one end of a nail head when the nail is received in the "V" shaped groove and driving the nail in a nail receiving surface. The length "D" is in a range of 1½ to 2 inches for the handling of different sizes and lengths of nails. In FIG. 2, a side view of a double headed scaffold nail 48 is shown having a double head 50 which is received along a length "d3" of the slot 36. The length "d3" of the slot 36 is in a range of ½ to ¾ inches for receiving a portion of different lengths of nail heads, such as double head 50, in the slot 36. The slot 36 is used for helping hold the nail on the top portion 30 of the nose 22. In this drawing, the scaffold nail 48 is longer than 2 inches thereby allowing a pointed end 51 of the nail 48 to extend outwardly from the nail striking surface 28 for the initial driving of the nail 48 into a nail receiving surface. The nail receiving surface is not shown in the drawings.

Also, another important feature of the hammerhead 10 is the relationship of the magnet 40 to the nail striking surface 28. In FIG. 2, a vertical centerline A—A is shown through the center of the magnet 40 and the knock out hole 44. A length "d1" is a distance from the nail striking face 28 and the centerline A—A of the magnet 40. The length "d1" is in a range of ¼ to ⅜ inches. By placing the magnet 40 near the nail striking face 28, the hammerhead 10 is able to hold small and short finishing nails and for driving the small nails into a nail receiving surface.

The top portion 30 of the nose 22 also includes an inverted "U" shaped notch 52. The "U" shaped notch 52 is used for receiving an inverted "U" shaped striking bar 53. An upper portion of the "U" shaped striking bar is used for engaging a nail head of a small finishing nail. The striking bar 53 is shown and discussed under FIG. 5. In FIG. 2, a length "d2" is a distance from the nail striking face 28 and a side of the "U" shaped notch 52. The length "d2" is in a range of ⅜ to ½ inches. Any small finishing nail or the like having a length of greater than ⅝ inches can be used on the top of the hammerhead 10 with a pointed end of the nail extending outwardly from the nail striking surface 28 for initially driving the small nail into a nail receiving surface.

Figure 3:
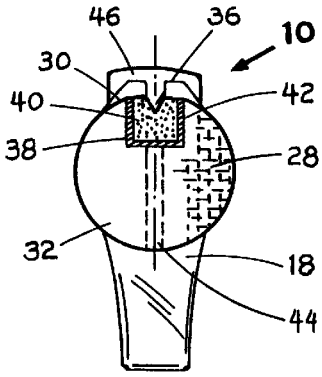
FIG. 3 is a front view of the nose of the hammerhead with a portion of the nose cut away to illustrate the magnet mounted in place in the top of the nose. The knock-out hole is shown in dotted lines.

In FIG. 3, a front view of a portion of the nose 22 is shown cut away with the magnet 40 mounted in place, The knock-out hole 44 is shown in dotted lines. In this view, the contour of the "V" shaped groove 34 can be clearly seen for receiving different sizes and types of nails and other types of fasteners.

Figure 4:
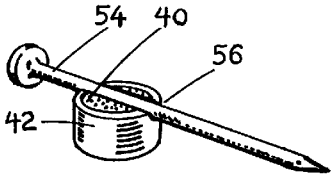
FIG. 4. is perspective view of the magnet with a sleeve surrounding the magnet. The magnet is shown removed from the hammerhead and engaging a typical construction type nail.

In FIG. 4. a perspective view of the magnet 40 is illustrated with the sleeve 42 surrounding the magnet 40. The magnet 40 is shown removed from the hammerhead 10 and shown engaging a typical construction type nail 54. Note the top of the magnet 40 includes a "V" shaped groove 56 which corresponds with the contour of the "V" shaped groove 34 along the length of the top portion 30 of the nose 22. By having the "V" shaped groove 56 in the top of the magnet 40, a greater portion of the nail 54 is exposed to and engaged by the top of the magnet 40. This feature provides for greater magnetic holding power when the nail is received is the "V" shaped groove 34 in the top of the nose 22.

Figure 5:
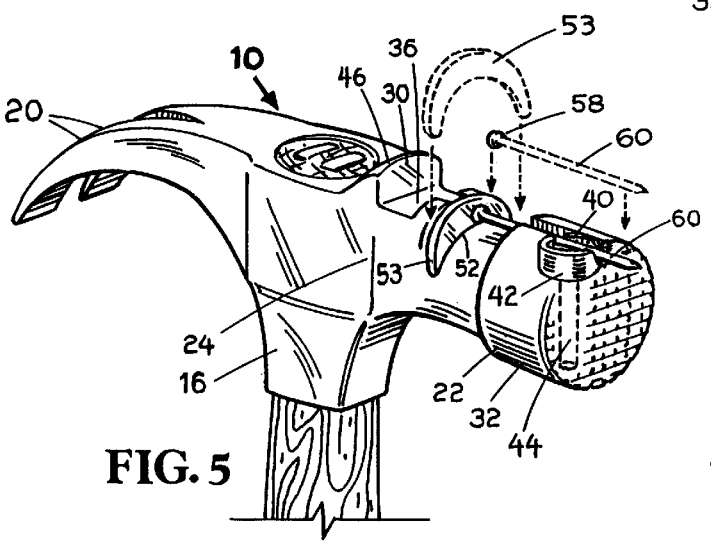
FIG. 5. is a perspective view of the hammerhead showing an inverted "U" shaped striking bar mounted on top of the nose. The striking bar is used to engage a head of a small finishing nail when it is received in a "V" shaped groove along the length of the top of the nose. The striking bar is used to start the initial driving of the nail into a nail receiving surface.

In FIG. 5, a perspective view of the hammerhead 10 is illustrated with the inverted "U" shaped striking bar 53 shown in dotted lines above the inverted "U" shaped notch 52. The striking bar 53 is also shown in this drawing removably mounted in the notch 53 in the top portion 30 of the nose 22. An upper portion of the "U" shaped striking bar 53, when received in the notch 52, is also received in a portion of the "V" shaped groove 34. The striking bar 53 is used for engaging a head 58 of a small finishing nail 60. The finishing nail 60 is also shown in dotted lines above the "V" shaped groove 34. Note the finishing nail 60 has sufficient length so that it's pointed end extends outwardly from the nail striking surface 28. The feature of having the removable striking bar 53 received on the top portion 30 of the nose 22 allows for using the hammerhead 10 in starting small nails, tacks and brads, having a length greater than of ⅜ inches, into a nail receiving surface.

From the above discussion, it can be appreciated that the subject improved hammerhead 10 can be used with the features of the magnet 40, the "V" shaped grooves 34 and 56, the removable inverted "U" shaped striking bar 53, and the upright striking surface 46 with slot 36 for holding and engaging different types, sizes and lengths of nails and the like. The hammerhead 10 allowing for driving nails and fasteners into a surface without the need of holding each item in one hand.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A hammerhead used for magnetically holding different sizes and lengths of nails with nail heads, the hammerhead used for driving a nail into a nail receiving surface, the hammerhead comprising:

an annular shaped nose, said nose having a rear portion integral to and extending outwardly from a head member, further said nose having a front portion with a nail striking face, a top portion and a bottom portion;

a magnet mounted in the top portion of said nose, said magnet disposed next to said nail striking face; and a knock-out hole in said nose, whereby said knock-out hole is used for removing said magnet when damaged or when said magnet loses magnetic flux.

2. The hammerhead as described in claim 1 wherein said magnet includes a non-ferrous sleeve therearound, whereby said non-ferrous sleeve is used for helping extend the life of the magnet's magnetic flux when said magnet is mounted on said nose.

3. The hammerhead as described in claim 1 wherein the top portion of said nose includes a "V" shaped groove along the length of the nose, said magnet also having a "V" shaped groove in a top thereof, said "V" shaped groove in said magnet indexed with said "V" shaped groove of said nose, whereby said "V" shaped grooves adapted for receiving a portion of the nail and holding the nail therein.

4. The hammerhead as described in claim 3 wherein the top of portion of said nose includes a slot with an upright striking surface therein, said slot disposed next to one end of said "V" shaped groove in said nose, whereby said slot adapted for receiving the nail head of the nail therein with said upright striking surface disposed next to one end of the nail head.

5. A hammerhead used for magnetically holding different sizes and lengths of nails with nail heads, the hammerhead used for driving a nail into a nail receiving surface, the hammerhead comprising:

an annular shaped nose, said nose having a rear portion integral to and extending outwardly from a head member, further said nose having a front portion with a nail striking face, a top portion and a bottom portion;

a magnet with a non-ferrous sleeve disposed therearound, said magnet with said non-ferrous sleeve mounted in the top portion of said nose, said magnet disposed next to said nail striking face; and a knock-out hole in said nose, whereby said knock-out hole is used for removing said magnet with non-ferrous sleeve when said magnet is damaged or when said magnet looses magnetic flux.

6. The hammerhead as described in claim 5 wherein the top portion of said nose includes a "V" shaped groove along the length of the nose, said magnet with non-ferrous sleeve also having a "V" shaped groove in a top thereof, said "V" shaped groove in said magnet with non-ferrous sleeve indexed with said "V" shaped groove of said nose, whereby said "V" shaped grooves adapted for receiving a portion of the nail and holding the nail therein.

7. The hammerhead as described in claim 6 wherein the top of portion of said nose includes a slot with an upright striking surface therein, said slot disposed next to one end of said "V" shaped groove in said nose, said upright striking surface a distance in a range of 1½ to 2 inches from said nail striking surface.

8. The hammerhead as described in claim 6 wherein the top portion of said nose includes an inverted "U" shaped notch with a removable inverted "U" shaped striking bar mounted in said notch, an upper portion of said striking bar disposed in said "V" shaped groove in the top portion of said nose.

9. The hammerhead as described in claim 5 wherein the top portion of said nose includes an inverted "U" shaped notch with a removable inverted "U" shaped striking bar mounted in said notch, whereby said striking bar adapted for engaging one end of nail heads of small nails.

10. A hammerhead used for magnetically holding different sizes and lengths of nails with nail heads, the hammerhead used for driving a nail into a nail receiving surface, the hammerhead comprising:

an annular shaped nose, said nose having a rear portion integral to and extending outwardly from a head member, further said nose having a front portion with a nail striking face, a top portion and a bottom portion;

a magnet mounted in the top portion of said nose, said magnet disposed next to said nail striking face;

a "V" shaped groove along the length of the nose, a top portion of said magnet disposed in said "V" shaped groove;

a slot with an upright striking surface therein, said slot disposed next to one end of said "V" shaped groove in said nose; and an inverted "U" shaped notch disposed in the top portion of said nose, said notch having a removable inverted "U" shaped striking bar mounted therein.

11. The hammerhead as described in claim 10 wherein said nose includes a knock-out hole therein, whereby said knock-out hole is used for removing said magnet when damaged or when said magnet loses magnetic flux.

12. The hammerhead as described in claim 10 wherein said magnet includes a non-ferrous sleeve therearound, whereby said nonferrous sleeve is used for helping extend the life of the magnet's magnetic flux when said magnet is mounted on said nose.

13. The hammerhead as described in claim 10 wherein said magnet has a "V" shaped groove in a top thereof, said "V" shaped groove in said magnet indexed with said "V" shaped groove of said nose, whereby said "V" shaped grooves adapted for receiving a portion of the nail and holding the nail therein.

* * * * *